US005103433A

United States Patent [19]

Imhof

[11] Patent Number: 5,103,433

[45] Date of Patent: Apr. 7, 1992

[54] METHOD OF ASCERTAINING THE TIMES OF PARTICIPANTS IN RACES AND OTHER CONTESTS

[76] Inventor: Augustin Imhof, Winterhalde 8, D-7619 Steinach, Fed. Rep. of Germany

[21] Appl. No.: 195,123

[22] Filed: May 16, 1988

[30] Foreign Application Priority Data

May 21, 1987 [DE] Fed. Rep. of Germany ..... 3716987

[51] Int. Cl.[5] ..... G04F 8/00; G04F 10/00

[52] U.S. Cl. ..... 368/9; 368/10; 346/1.1; 346/107 B

[58] Field of Search ..... 368/8-10, 368/107, 113, 118; 346/107 B, 1.1

[56] References Cited

U.S. PATENT DOCUMENTS

| | | | |
|---|---|---|---|
| 3,502,009 | 3/1970 | Connors | 346/107 B |
| 3,508,034 | 4/1970 | Toyama et al. | 368/107 |
| 3,596,103 | 7/1971 | Matthews et al. | 368/113 |
| 3,781,529 | 12/1973 | Abramson et al. | 368/118 |
| 4,523,204 | 6/1985 | Bovay | 354/109 |

*Primary Examiner*—Bernard Roskoski
*Attorney, Agent, or Firm*—Peter K. Kontler

[57] ABSTRACT

The times of participants in automobile, foot, dog, bicycle or other races are ascertained by employing a video camera which takes pictures of the finish line and its surroundings at intervals of 1/25 second and by employing at least one photoelectronic detector which generates a signal when the winner or any other participant crosses the finish line and interrupts the beam of radiation between the radiation source and the transducer of the detector. Information denoting the times of taking the pictures and the times of those participants who or which have interrupted the beam of radiation is recorded on the pictures. The times of other participants who or which do not individually interrupt the beam of radiation are calculated on the basis of the recorded information and, if necessary, with assistance from a calculator which applies to the pictures a scale with lines spaced apart from each other by distances corresponding to those covered by a participant within 1/100 second.

14 Claims, 6 Drawing Sheets

104
4
1
16
2
2
2
2
2
2
19
18
3
15
21
20
17
105
TO CAMERA 6
5
13
10
CLOCK
14
MONITOR
VIDEO RECORDER
TIMING PULSE GENERATOR
VIDEO CAMERA
11
9
8
PRINTER
12
7
6
8'
106
TIME DELAY

FIG. 6
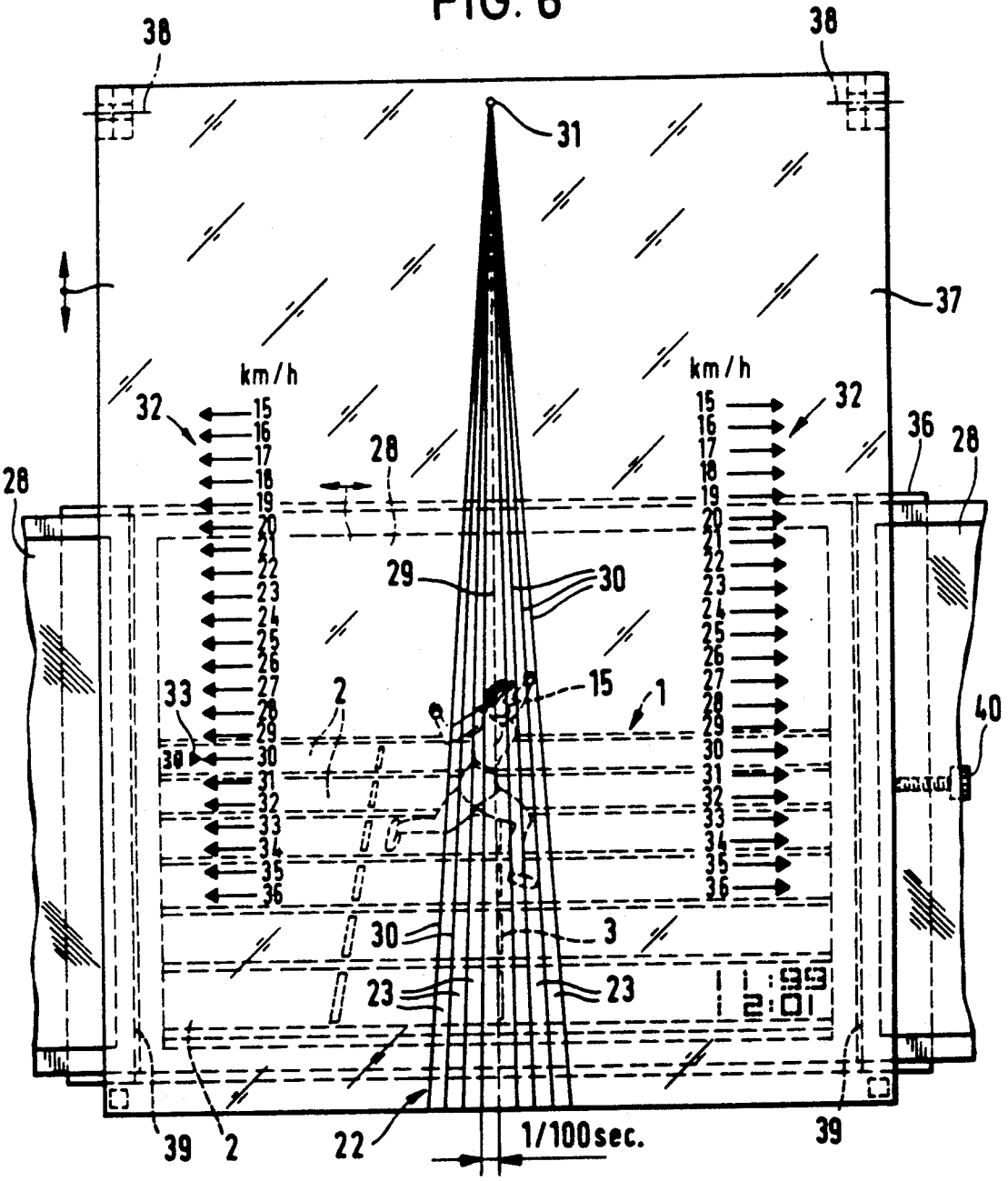
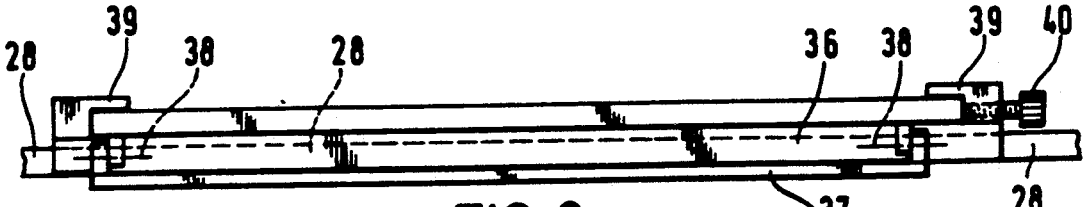
FIG. 8

METHOD OF ASCERTAINING THE TIMES OF PARTICIPANTS IN RACES AND OTHER CONTESTS

BACKGROUND OF THE INVENTION

The invention relates to a method of and to an apparatus for ascertaining the times which elapse during contests between animate and/or inanimate participates of races and other contests, for example, during contests between motor vehicles, human beings, animals and/or human beings on animals or in motor vehicles or other types of vehicles (including boats, bicycles, sleds, skis and others).

It is often desirable to ascertain the times of various contestants or participants with a very high degree of accuracy, normally within fractions (especially hundredths) of a second. This holds true for contests including foot races, horse races, automobile races, dog races, boat races, ski races and a number of others. As a rule, the contest is started in response to the firing of a starter gun or in response to opening of one or more gates, and the contest for a particular participant is terminated when such participant reaches (i.e., crosses) the finish line. It is customary to install a camera at the finish line as well as to install at the finish line a monitoring device (such as a combination of a radiation source and an optoelectronic transducer) which generates a signal denoting the exact time when a participant reaches the finish line and thus interrupts the beam of radiation between the radiation source and the transducer. It is further known to employ a video camera in conjunction with a monitor which provides a series of pictures of the finish line and the adjacent portion of the track and/or which is connected with a suitable printer serving to furnish still pictures at selected intervals. For example, the camera will take pictures at intervals of four hundredths of a second, and the equipment at the finish line will further include means for recording on each picture the exact time (counting from the start of the contest) when the respective picture was taken.

A drawback of heretofore known apparatus which are used to ascertain the times of participants in a contest (such as a foot race, a ski race, an automobile race or a horse race) is that the equipment is very expensive as well as that such equipment does not permit immediate and automatic determination of times of various participants, not even of the winner of the contest. Thus, if the winner happens to cross the finish line at an instant which does not coincide with the making of a picture by the camera at the finish line, the time which is recorded on the picture (and denotes the instant of taking the picture) need not always coincide with the instant when the beam of radiation from the source to the transducer of the aforediscussed monitoring device is interrupted by the winner. Thus, it happens again and again that the picture of the winner at the finish line shows the winner at a time when she, he or it has already advanced at least slightly beyond the finish line.

It was further proposed to provide the apparatus at the finish line with means for recording a series of increments of time at intervals which are indicative of an estimated average speed of the participants. This is done for the purpose of facilitating the determination of times of also rans, i.e., of participants crossing the finish line behind the winner. A drawback of such proposal is that the average speeds are mere estimates and can considerably depart, especially in the region of the finish line, from actual speeds of the participants. This greatly affects the accuracy of determination of the times of also rans with attendant inaccuracies in determination of fastest times of second, third, fourth etc. finishers of a contest. The exact times of also rans are or can be of great importance in many short foot races (100 yards, 200 yards, 100 meters, 200 meters, etc.) if only the participants with fastest preliminary heat times qualify for the finals.

For example, if a short foot race is assumed to be run at a preselected average speed but a preliminary heat happens to involve a group of exceptionally fast runners or highly competitive runners who complete the heat much faster than anticipated (i.e., at an average speed considerably exceeding the anticipated average speed), the list of finalists may not include those with the fastest times in the preliminary heats. An error in the range of one hundredth of a second suffices to disqualify from the finals one or more contestants whose preliminary heat times were estimated in accordance with heretofore known proposals. At the very least, certain participants will not be ranked according to their true times during preliminary heat so that they will have to accept less satisfactory lanes or, in the case of horse or automobile races, lanes which are more distant from the pole or rail than warranted by the performances of such participants during the preliminary races.

The equipment which is used at important sports events, such olympic games, world championships, international automobile ski races and like contests is highly sophisticated and is capable of accurately determining the finish times of participants, even when the finish times of several participants differ only by minute fractions of a second. The equipment normally includes numerous computers, cameras and picture making units including monitors, printers and others. Such equipment is much too expensive for use at a club level, at a high school level or even at a college level.

OBJECTS AND SUMMARY OF THE INVENTION

An object of the invention is to provide a simple but reliable method of ascertaining the times of animate and/or inanimate participants in contests.

Another object of the invention is to provide a method which renders it possible to accurately ascertain the winning time as well as the times of also rans with an accuracy of one or more hundredths of a second.

A further object of the invention is to provide a method which renders it possible to determine the times of participants other than the winner with the same degree of accuracy as that of the winner.

An additional object of the invention is to provide a method which renders it possible not only to ascertain but also to record the times of all participants in a contest regardless of the differences between their times.

Still another object of the invention is to provide a novel and improved apparatus for the practice of the above outlined method, and to provide the apparatus with novel and improved means for facilitating rapid determination of times of all participants in a contest.

A further object of the invention is to provide the apparatus with novel and improved means for recording information which can be used to ascertain the times of also rans in a foot race, ski race, horse race, automobile race, dog race or any other contest wherein two or more participants walk, run, roll, slide and/or otherwise move from a predetermined start line to a predetermined finish line.

Another object of the invention is to provide the apparatus with novel and improved means for ascertaining the times of also rans in a contest with the same degree of accuracy (not less than one or more hundredths of a second) as the time of the winner of the contest.

A further object of the invention is to provide an apparatus which is sufficiently inexpensive to be affordable by smaller organizations including private clubs, elementary schools, high schools, small colleges, rehabilitation centers, police academies and many others.

One feature of the present invention resides in the provision of a method of ascertaining the times which elapse during contests between animate and/or inanimate participants, such as during foot races, automobile races, dog races and horse races, wherein the finish line and its surroundings are imaged by at least one camera and are monitored by at least one monitoring device which generates a first signal when the finish line is crossed by the winner of the contest. The method comprises the steps of making with the camera a sequence of pictures of the finish line and its surroundings at predetermined intervals (e.g., at four one-hundredths (1/25) of a second), a first recording step which includes recording on successive pictures of the aforementioned sequence first information including those periods of a series of successive periods of time which elapse between the start of the contest and the taking of successive pictures at the predetermined intervals, and a second recording step including recording on the respective picture second information including that period of time which elapses between the start of the contest and the generation of the first signal by the monitoring device when the winner crosses the finish line so that such picture of the winner in the process of (or immediately after) crossing the finish line then bears the corresponding first as well as the second information.

The method can further comprise the step of generating a second signal at the start of the contest so that the difference between the times of generating the first and second signals is directly indicative of the time which is spent by the winner to complete the contest from the start to the finish line.

The monitoring device generates a first signal whenever the finish line is crossed by a participant, including the initial crossing of the finish line by the winner of the contest as well as each crossing of the finish line by an also ran who or which reaches the finish line after the preceding finisher or finishers have advanced beyond the finish line. The second recording step of such method can include recording on the respective pictures (showing the participants crossing the finish line or immediately after crossing) second information including those periods of time which elapse between the start of the contest and the generation of first signals by the monitoring device when the winner as well as each also ran crosses the finish line so that each picture which contains the image of a participant crossing the finish line and triggering the generation of a first signal bears the corresponding first and the respective second information. Such method can further comprise the step of recording the second information on at least one picture immediately following the picture which is being taken at the time of generation of a first signal by the monitoring device so that each such following picture bears the image of the finish line, of the participant whose crossing of the finish line has initiated the recording of second information as well as different first and second information. The difference between the first and second information on a following picture is proportional to the distance the participant whose crossing of the finish line has initiated the generation of the respective first signal has advanced beyond the finish line.

The just outlined method can serve to ascertain the times which elapse during contests between participants crossing the finish line in such close proximity to each other that one of the participants initiates the generation of a first signal as a result of crossing the finish line but at least one additional participant trails the one participant by a distance such that the additional participant does not initiate the generation of a first signal by the monitoring device because the additional participant crosses the finish line before the one participant has advanced all the way beyond the finish line. Such method further comprises the steps of ascertaining the distance which is covered by the additional participant during the interval which has elapsed between the making of at least two successive pictures bearing the images of the additional participant in the region of the finish line, and calculating the time differential between completions of the contest by the one participant and by the additional participant on the basis of the aforementioned distance and the predetermined interval between the making of two successive pictures. The calculating step can include subdividing the interval between the making of two successive pictures into shorter intervals, and adding one or more shorter intervals to or subtracting one or more shorter intervals from the second information on the picture immediately following the picture which was taken at the time of generation of the first signal as a result of the one participant crossing the finish line.

The method can comprise the step of subdividing the distance which is covered by each participant whose crossing of the finish line has triggered the generation of a first signal between the positions shown on the picture bearing the second information and a following picture into distances which were covered by the respective participant during a predetermined unit of time (e.g., 1/100th of a second).

The method can also comprise the step of determining the distance which is covered during a predetermined unit of time (such as 1/100 second) by each participant whose crossing of the finish line has triggered the generation of a first signal, and such step can include establishing the difference in time between the first and second information on the picture bearing the image of the participant whose crossing of the finish line has triggered the generation of a first signal, and establishing from the picture bearing such image the total distance which is covered by the respective participant during the period between the crossing of the finish line - as denoted by the second information - and the recording of the first information. This method can further comprise the step of projecting or placing onto the picture bearing the aforementioned image a scale with graduations (e.g., a bundle of straight lines) denoting a series of distances corresponding to that which is covered during the predetermined unit of time so that one of the graduations coincides with the image of the finish line or is equidistant from the image of the finish line and a neighboring graduation. The determining step can include electronically computing the distance which is covered during the predetermined unit of time (such as 1/100 second), and imaging the respective scales onto the pictures showing the participants whose crossing of the finish line has triggered the generation of first signals by the monitoring device. The computing step includes utilizing the distance from the start to the finish line as one of the parameters for determination of the distance which is covered per unit of time (e.g., 1/100 second) and utilizing as another parameter an arbitrarily selected unit distance from the finish line such as is covered by an object moving at a predetermined speed within one of the aforementioned intervals. Such method can further comprise the step of projecting onto the image-bearing picture a second scale with graduations denoting a series of different speeds including the speed of the participant in the image. The graduations of the at least one second scale can form a row extending in parallelism with the image of the finish line when the first named scale is projected or placed onto the image on the picture showing a participant whose crossing of the finish line has triggered the generation of a first signal.

The method can further comprise the step of determining the speed of each participant whose crossing of the finish line has triggered the generation of a first signal, including establishing the difference between the first and second information on the picture bearing the image of the participant whose crossing of the finish line has triggered the generation of a first signal and establishing from the picture the total distance covered by the respective participant during the period between the crossing of the finish line—as denoted by the second information—and the time of recording the first information.

Another feature of the invention resides in the provision of an apparatus for ascertaining the times which elapse during contests between animate and/or inanimate participants, such as during foot races, automobile races, bicycle races, dog races and horse races, which involve advancement of participants toward and their crossing of a finish line. The apparatus comprises at least one camera which serves to make a sequence of pictures at the finish line at predetermined intervals, at least one monitoring device which serves to generate a first signal when the finish line is crossed by the winner of the contest, first recording means including means for recording on successive pictures of the aforementioned sequence of pictures first information including those periods of a series of successive periods of time which elapse between the start of the contest and the taking of successive pictures at the predetermined intervals, and second recording means including means for recording on the respective picture (i.e., not on each picture) second information including that period of time which elapses between the start of the contest and the generation of the first signal when the winner crosses the finish line so that such picture then bears the corresponding first information as well as the second information.

The shutter of the camera is preferably designed to furnish f/stops in the range of between one-hundredth and one-thousandth of a second (e.g., 1/100, 1/500 and 1/1000).

The camera is preferably a video camera, and the apparatus then further comprises video recorder means connected with the video camera and means (such as one or more monitors and/or a printer of still pictures) for rendering visible the pictures of the aforementioned sequence. The first and second recording means can include timing pulse generators which are connected between the video camera and the video recorder means. Still further, the apparatus preferably comprises means for resetting the recording means and means (such as a starter gun) for transmitting to the recording means impulses denoting the start of the contest.

The monitoring device can include a plurality of photoelectronic detectors which are disposed at different levels. For example, the monitoring device can comprise two detectors which are disposed one above the other at a level above the finish line. At least one of these detectors can include a source of infrared radiation and a transducer which is exposed to radiation from such source when the finish line is not crossed by a participant in the contest or a participant has advanced beyond the finish line to an extent less than necessary to enable the beam of infrared radiation to reach the transducer.

The apparatus can comprise means for starting the camera when the leading participant is located at a preselected distance from the finish line. Such starting means can comprise a photoelectronic detector. Still further, the apparatus can be equipped with a time delay unit or with any other suitable means for arresting or deactivating the camera with a preselected delay, particularly upon completion of a preselected number of pictures. This prevents the camera from taking unnecessary pictures of the finish line and its surroundings at the time when no additional participants are expected to cross the finish line.

The apparatus can also comprise at least one additional recording means to record information with a delay following the begin of recording of information by the first recording means, particularly while the first recording means continues to record information. Such apparatus can be employed to ascertain the times of participants in successive contests which overlap, i.e., a preceding contest is still in progress while the next-following contest has already begun.

The apparatus can also comprise calculator means (actually calculation facilitating means) having a scale with a plurality of graduations (particularly in the form of a bundle of lines which are parallel to each other or which intersect each other at the perspective center of the camera). The mutual spacing of such graduations corresponds to distances covered by a participant within a minute fraction of a second (e.g., one-hundredth of a second). One of the graduations preferably coincides with (i.e., exactly overlaps) the image of the finish line on the screen of a monitor or on a still picture which is turned out by the printer, or such one graduation is equidistant from the image of the finish line and from another (neighboring) graduation. The calculator means means can include means for moving the scale relative to the pictures on the screen of the monitor or relative to still pictures in the longitudinal direction of the image of the finish line so as to conform the positions of the graduations to the speed of the participant crossing the finish line on the respective image.

For example, the calculator means can comprise an adjustable parallelogram with a scale including a plurality of lines which are substantially parallel to each other and to the image of the finish line when the scale is properly related to the image of the finish line and its surroundings. Such calculator means then preferably further comprises means for simultaneously varying the mutual spacing of the lines.

The calculator means can include a computer (such as a microprocessor) which causes the video camera to project onto the screen of the monitor or onto each picture a scale with graduations one of which coincides with the image of the finish line. The graduations are spaced apart from each other by increments denoting distances covered by a participant during minute fractions of a second, e.g., during intervals of 1/100 second. The scale can be imaged on the middle of the image of the track for participants in the region of the finish line, or the scale can be imaged at one or more margins of each picture. If the calculator means comprises a computer, the latter is provided with a plurality of inputs one of which receives data including the distance from the start to the finish line and another of which receives the aforementioned second information.

If the scale includes a bundle of lines which intersect each other at the perspective center of the camera, one of these lines (namely a reference line) coincides with the image of the finish line and the bundle preferably comprises a set of (e.g., four) additional lines at each side of the one line.

As mentioned above, the calculator means can include means for moving the scale in the longitudinal direction of the image of the finish so as to move different portions of the bundle of lines into register with selected portions of the pictures showing the finish line. Such adjustment will be carried out with a view to take into consideration the perspective of each picture, i.e., the fact that the distance between neighboring objects on the image appears to decrease as the distance from the picture taking lens of the camera increases.

The calculator means can apply to each picture at least one additional scale with graduations denoting different average speeds of the participants in a contest. The graduations of the additional scale preferably form a row extending in substantial parallelism with the lines of the bundle of lines. The scale can be applied to a rigid or flexible light-transmitting carrier which can overlie the screen of a monitor or can be imaged onto still pictures. The calculator means with a rigid carrier of the bundle of lines can be provided with a compartment or chamber for reception of still pictures, one at a time. The bundle of lines overlies the image on the picture in the chamber, preferably in such a way that the aforementioned reference line coincides with the image of the finish line. Such calculator can further comprise means for effecting a movement of the carrier and chamber relative to each other (especially for moving the chamber relative to the carrier) substantially in the longitudinal direction of the image of the finish line on the picture in the chamber.

If the carrier is flexible, it can assume the form of a band or web with one end affixed to a first rotary advancing member (e.g., the core of a first reel or roll) and with the other end affixed to a second rotary advancing member (such as the core of a second roll or reel). When the reels are rotated in a first direction, the carrier is wound onto one of the cores and is paid out by the other core. This movement takes place in such a way that the reference line of the bundle moves in the longitudinal direction of (i.e., it remains in register with) the image of the finish line. The advancing members can be mounted in a frame for movement transversely of the bundle of lines to permit the placing of a selected line into register with the image of the finish line.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 6 is a plan view of a modified calculator which can also furnish the scale of FIG. 3;

FIG. 8 is an end elevational view of the calculator of FIG. 6.

DESCRIPTION OF THE PREFERRED EMBODIMENTS

Figure 1:
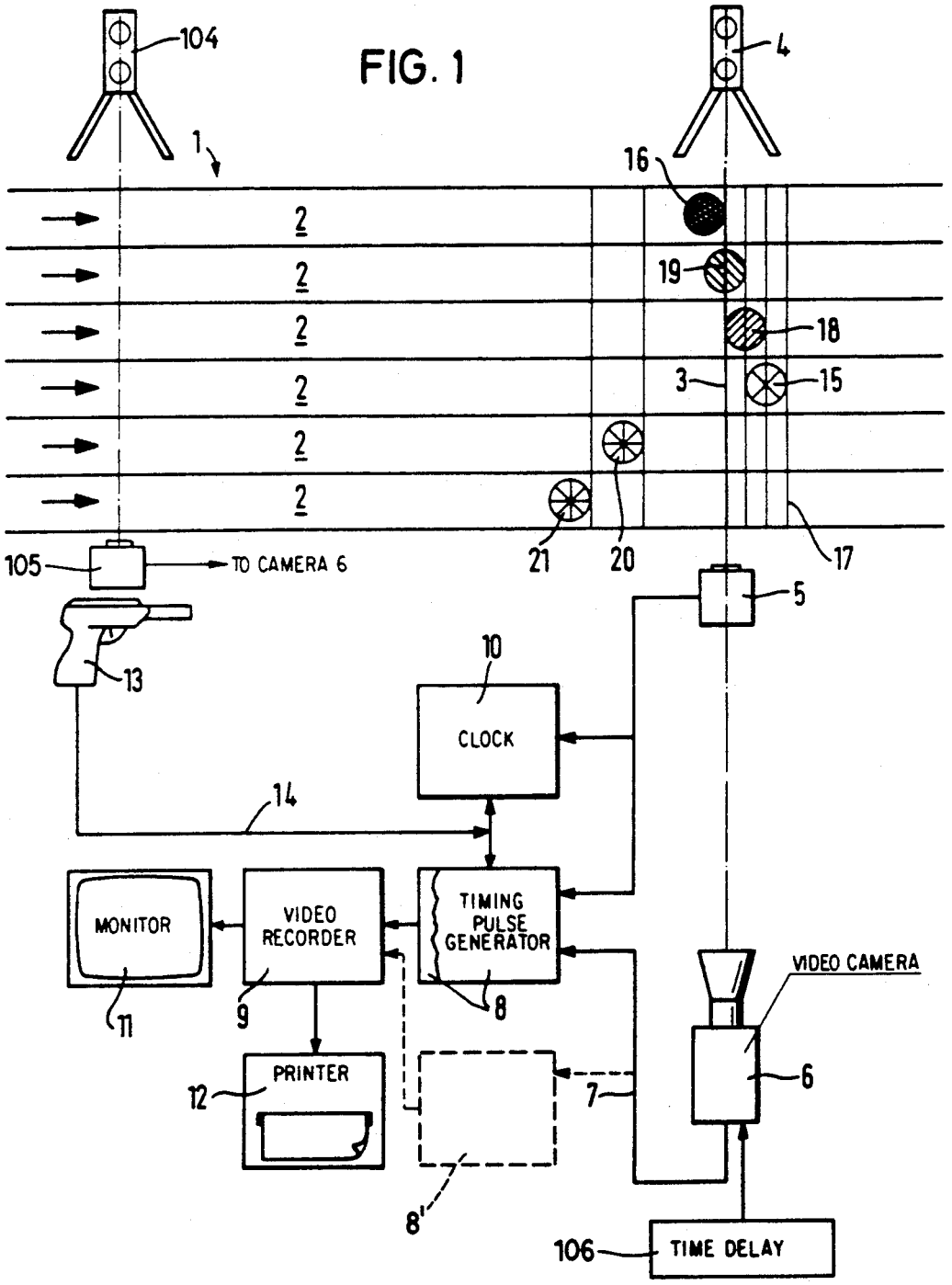
FIG. 1 is a plan view of a track with six lanes and a finish line, and a block diagram of an apparatus which embodies one form of the invention.

FIG. 1 shows a track 1 with six lanes 2 and a finish line 3 which is monitored by a photoelectronic detector including a radiation source 4 at one side of the track 1 and a transducer 5 at the other side of the track. The beam of radiation which issues from the source 4 and normally impinges upon the transducer 5 is coplanar with the finish line 3. The apparatus further comprises a video camera 6 which is located behind the transducer 5 and is provided with equipment including a shutter enabling the camera to take pictures at predetermined intervals, for example, at intervals of four hundredths of a second. The pictures can be taken for the entire duration of a contest, such as a foot race between six participants 15, 18, 19, 16, 20, 21 (shown schematically in the order of their respective finishes), or the taking of pictures can begin shortly or immediately before the winner (15) of the contest reaches the finish line 3.

The video camera 6 is connected by conductor means 7 with two timing pulse generators 8 and a video recorder 9. The circuit including the video camera 6 further includes a starter clock 10 which is connected with the transducer 5 and (by conductor means 14) with a starter gun 13 which starts the clock 10 when the six participants in the contest leave the starting line. The gun 13 is further connected to the corresponding inputs of the timing pulse generators 8.

The video recorder 9 is connected with a monitor 11 and/or with a printer 12 of still pictures.

Each of the timing pulse generators 8 serves as a means for recording on the screen of the monitor 11 and/or on the still pictures which are turned out by the printer 12 first and second information including certain periods of time which begin to run from the start of the contest, i.e., in response to depression of the trigger on the starter gun 13. One of the timing pulse generators 8 causes the image on the screen of the monitor 11 as well as each still picture which is produced by the printer 12 to contain information indicating the time of taking the respective picture by the video camera 6 (i.e., at intervals of four hundredths of a second). The other timing pulse generator 8 initiates the recording of information on certain images on the screen of the monitor 11 and on certain still pictures, namely on the pictures which are being taken at the time a participant (15, 20 or 21) interrupts the beam of radiation between the source 4 and the transducer 5 (the latter then transmits a (first) signal to the respective timing pulse generator 8 so that the corresponding picture contains first information denoting the exact time of taking the respective picture (counting from the time of starting the contest) as well as additional information denoting the time of the participant (15, 20 or 21) who or which has crossed the finish line 3 and such crossing has resulted in an interruption of the beam of radiation issuing from the source 4. In other words, each picture bears information denoting the exact time (starting with the beginning of the contest) of taking the respective picture, and certain pictures bear additional information which denotes the exact time (again measuring from the start of the contest) when a certain participant appearing in the picture has crossed the finish line 3, namely the time of crossing the line 3 by a participant who or which has interrupted the previously uninterrupted beam of radiation from the source 4 to the transducer 5.

Figure 3:
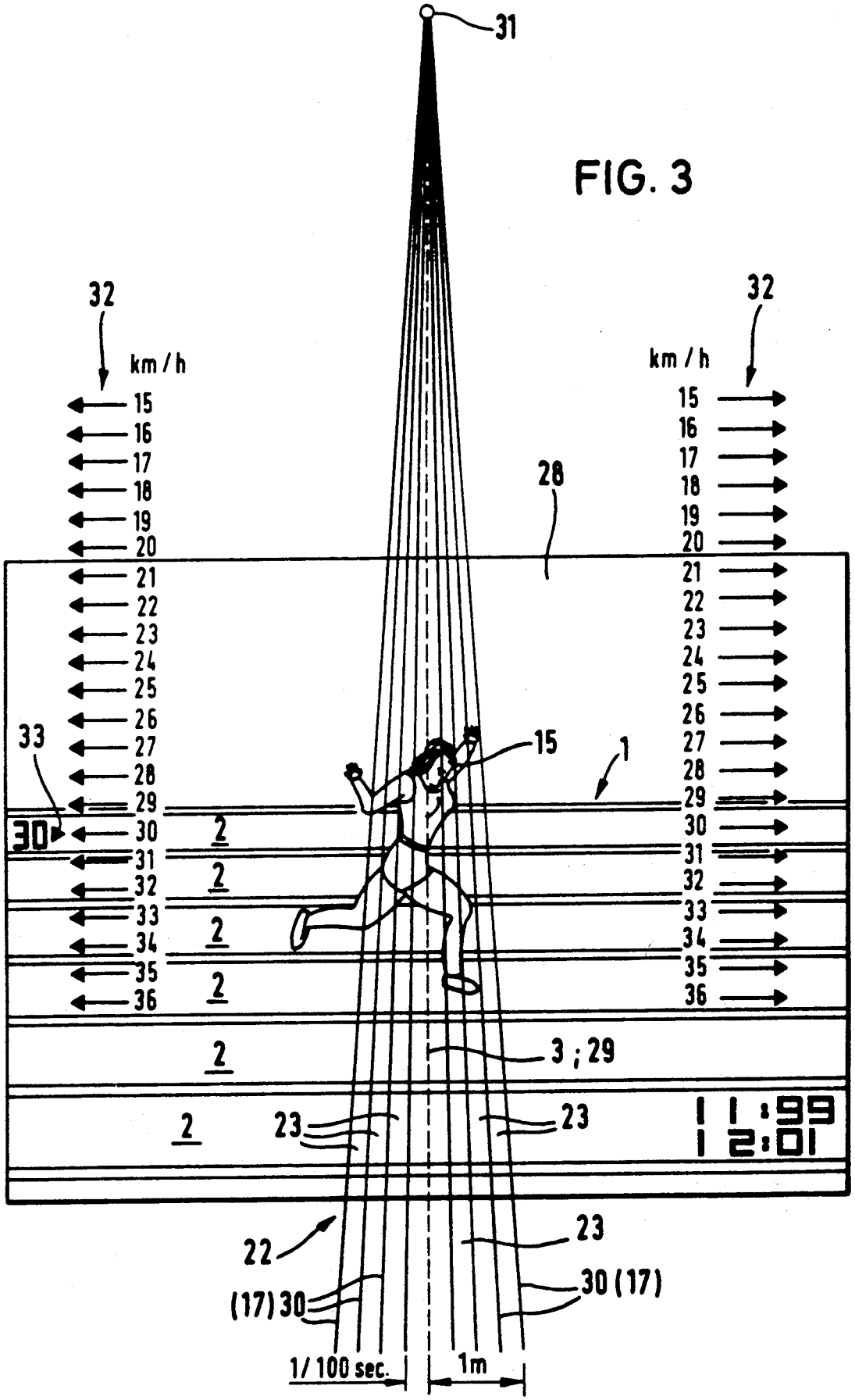
FIG. 3 shows a picture of the track of FIG. 1 and a scale with a bundle of lines which intersect each other in the perspective center of the camera and are projected onto the picture.

As can be seen in FIG. 3 for the winner 15 of the contest that involved the participants 15, 18, 19, 16, 20 and 21, a still picture 28 taken with the camera 6, furnished by the printer 12 and showing the winner 15 after the winner has crossed the finish line 3 bears information (11:99 seconds) denoting the time the chest of the participant (shown as a lady runner) has interrupted the beam of radiation from the source 4 to the transducer 5, and information (12:01 seconds) denoting the time the picture 28 of FIG. 3 was taken. Thus, and in contrast to the picture of FIG. 1, the picture 28 was taken nearly two hundredths of a second following crossing of the finish line 3 by the winner 15. The just discussed information is intended to denote the interval of time which has elapsed between the start of the race or heat involving the participants 15, 18, 19, 16, 20, 21 and the crossing of finish line 3 by the winner 15 (11:99 seconds), and the interval of time which has elapsed between the start of the race or heat and the taking of the picture 28 of FIG. 3.

FIG. 1 shows that the first also ran 18 (second finisher) has crossed the finish line 3 slightly behind the winner 15 so that the second finisher 18 did not actually interrupt the beam of radiation issuing from the source 4 but has merely prevented the beam from again impinging upon the transducer 5. The same applies for the second also ran 19 (third finisher) whose body partially overlaps the body of the second finisher 18, and for the third also ran 16 who or which is about to cross the finish line 3 but cannot initiate an interruption of the beam of radiation from the source 4 because such beam is still interrupted by the body of the participant 19. In other words, the beam is interrupted by the winner 15 and thereupon remains interrupted for a period of time which ends when the body of the third also ran 16 (fourth finisher) advances beyond the finish line 3. Consequently, that image on the screen of the monitor 11 which shows the winner 15 in the process of touching (crossing) the finish line 3 is followed by the picture of FIGS. 1 and 3 which shows the body of the winner 15 at least partially beyond the finish line and the body of at least one runner up in the process of crossing the finish line or already beyond the finish line.

FIG. 1 further shows that the winner 15 has crossed the finish line 3 three-hundredths of a second ahead of the third also ran 16 (who or which is about to cross the finish line). The distance between each pair of neighboring parallel graduations 17 of the scale shown in FIG. 1 denotes an interval of one hundredth of a second, such distance being based on the speed of the winner 15, preferably at or in the region of the finish line 3. The preceding picture shows the winner 15 in a position she or it assumes one-hundredth of a second prior to crossing of the finish line 3.

In actual practice, the scale including the lines 17 is or can be applied to the image on the monitor 11 or to the still picture 28 which is turned out by the printer 12 subsequent to actual taking of the pictures and based on information (FIG. 3) which is recorded on the picture 28 showing the participants in the positions of FIG. 1. Thus, the interval of time which has elapsed between the taking of the picture of FIG. 1 and the preceding picture is recorded by the first timing pulse generator 8, and the duration of such interval is 4/100 of a second. If the distance between the foremost portion of the body of the winner 15 in the preceding picture and in the picture of FIG. 1 is divided into four equal increments, the picture bearing such information shows that the winner has crossed the finish line three hundredths of a second ahead of the time the picture of FIG. 1 was taken. Furthermore, the picture will show that the second finisher 18 has crossed the finish line 3 only one-hundredth of a second behind the winner 15, and that the third finisher 19 has crossed the finish line 3 only two-hundredths of a second behind the winner 15, i.e., one-hundredth of a second ahead of the fourth finisher 16. The third finisher 19 is exactly midway between the second and fourth finishers 18, 16. A difference of less than one-hundredth of a second cannot always be readily discerned on a customary print or on a customary monitor, and a greater accuracy is hardly ever necessary in a race, not even in a 60-yard or 100-yard dash.

FIG. 1 shows that only the winner 15 has actually interrupted the beam of radiation from the source 4 to the transducer 5 because the three next finishers 18, 19, 16 are so close to each other or to the winner 15 that they have merely prevented the beam from reaching the transducer 5 but did not individually interrupt the beam. Therefore, it is necessary to calculate the times of the second, third and fourth finishers 18, 19, 16 on the basis of the images or pictures and the time of the winner 15.

The fifth finisher 20 is well behind the fourth finisher 16 so that the beam issuing from the radiation source 4 can reach the transducer 5 after the body of the fourth finisher 16 has advanced beyond the finish line 3 and before the finish line is reached by the fifth finisher 20. Therefore, the picture bearing the image of the fifth finisher 20 at the finish line 3 will contain information denoting the time of taking the picture as well as the exact time of the finisher 20 who or which has crossed the line 3. The same holds true for the sixth finisher 21 who or which trails the fifth finisher 20 by a distance which suffices to enable the beam of radiation from the source 4 to reach the transducer 5 after the finisher 20 has advanced beyond the line 3 and before such line is reached by the finisher 21. Thus, the picture bearing the image of the sixth finisher 21 at the line 3 will contain information denoting the time of taking the picture as well as the time of the finisher 21. However, if the sixth finisher 21 were so close to the fifth finisher 20 that the beam of radiation from the source 4 would remain interrupted at the time the finisher 21 has reached the finish line 3, the time of the participant 21 would have to be calculated from the time of the participant 20 and from a reading of the distance between the participants 20, 21 by perusing the graduations or lines 17 on the image of the participant 21 immediately prior to or immediately after crossing the finish line 3.

To summarize, FIG. 1 shows that the time of the winner 15 can be determined with utmost accuracy, even if the picture of the winner is taken subsequent to crossing of the finish line 3. Furthermore, FIG. 1 shows that the graduations 17 render it possible to determine the times of second and third finishers 18, 19 with practically the same high degree of accuracy by resorting to the scale including the graduations 17, such scale being determined on the basis of the time of the winner 15 and the time of taking the picture showing the winner immediately subsequent to crossing of the finish line. In other words, it is necessary to calculate the interval of time between the winning time and the time of taking the picture showing the winner 15 beyond the finish line 3. By coincidence, the time of the fourth finisher 16 in FIG. 1 matches the time of taking the picture of FIG. 1, i.e., the fourth finisher 16 has touched the finish line 3. This obviates the need for a calculation of the time of the fourth finisher 16. As to the fifth and sixth finishers 20 and 21, the exact times of these participants can be determined in a very simple way because the transducer 5 causes the clock 10 to initiate the generation of a signal at the exact instant when the beam of radiation issuing from the source 4 is interrupted by the participant 20 and again when such beam of radiation is interrupted by the participant 21. The reason is that the participant 20 is sufficiently behind the participant 16 and the participant 21 is sufficiently behind the participant 20 to enable the beam or radiation to impinge upon the transducer 5 between the finish times of the fourth and fifth participants and again between the finish times of the fifth and sixth participants.

The taking of pictures by the camera 6 can be started with a delay following the start of the contest. To this end, the apparatus of FIG. 1 comprises a photoelectronic detector including a radiation source 104 at one side of the track 1 and a transducer 105 at the other side of the track 1 and in the path of the beam of radiation issuing from the source 104. When the front runner (such as the future winner 15) interrupts the beam of radiation which issues from the source 104, the transducer 105 generates a signal which is applied to the corresponding input of the camera 6 so that the latter starts to take pictures of the finish line 3 and its surroundings. The detector including the radiation source 104 and the transducer 105 is placed at a predetermined distance ahead of the finish line 3.

A time delay circuit 106 is provided to arrest the camera 6 with a preselected delay following crossing of the finish line 3 by the winner 15, i.e., with a predetermined delay following the generation of a first signal by the transducer 105. This ensures that the camera 6 need not take unnecessary pictures when the race is already completed. For example, the setting of the preferably adjustable time delay circuit 106 can be such that this circuit terminates the taking of pictures three or four seconds after the winner has crossed the finish line in a 100-yard dash.

The radiation source 4 of FIG. 1 can constitute the radiation source of the upper or uppermost of two, three or more discrete photoelectronic detectors each of which is in line with a discrete transducer 5. The beams which issue from such radiation sources are preferably disposed in a common plane including the finish line 3. Two or more superimposed photoelectronic transducers at the finish line 3 will be employed if the apparatus is to take pictures of those participants (15, 20, 21) whose bodies have interrupted the beam of radiation issuing from the source 4 at the exact moment of touching the finish line 3, i.e., if the video camera 6 (or another camera) is to take the picture of the winner 15 at the instant of touching the finish line 3, of the participant 20 at the instant of touching the finish line and of the participant 21 touching the finish line. At least one of two or more superimposed photoelectronic detectors in the region of the finish line 3 can employ a source of infrared radiation. Moreover, by employing two or more photoelectronic transducers at different levels above the finish line 3, one ensures that the first signal (denoting the time of the winner 15, of the participant 20 or of the participant 21) is not generated prematurely, e.g., by a forwardly extending hand of a male or female runner or sprinter. The arrangement may be such that a first signal is generated only when the body of the participant 15, 20 or 21 interrupts two or more beams of radiation at different levels above the finish line 3. For example, and referring to FIG. 1, the hand of the second finisher 18 could extend forwardly to initiate the generation of a first signal before the first finisher (winner) 15 actually reaches the finish line 3. This would give to the participant 15 a winning time which is less than the actual winning time. The provision of two or more photoelectronic detectors or other suitable monitoring means at the finish line 3 greatly reduces the likelihood of such undesirable generation of first signals.

Figure 2:
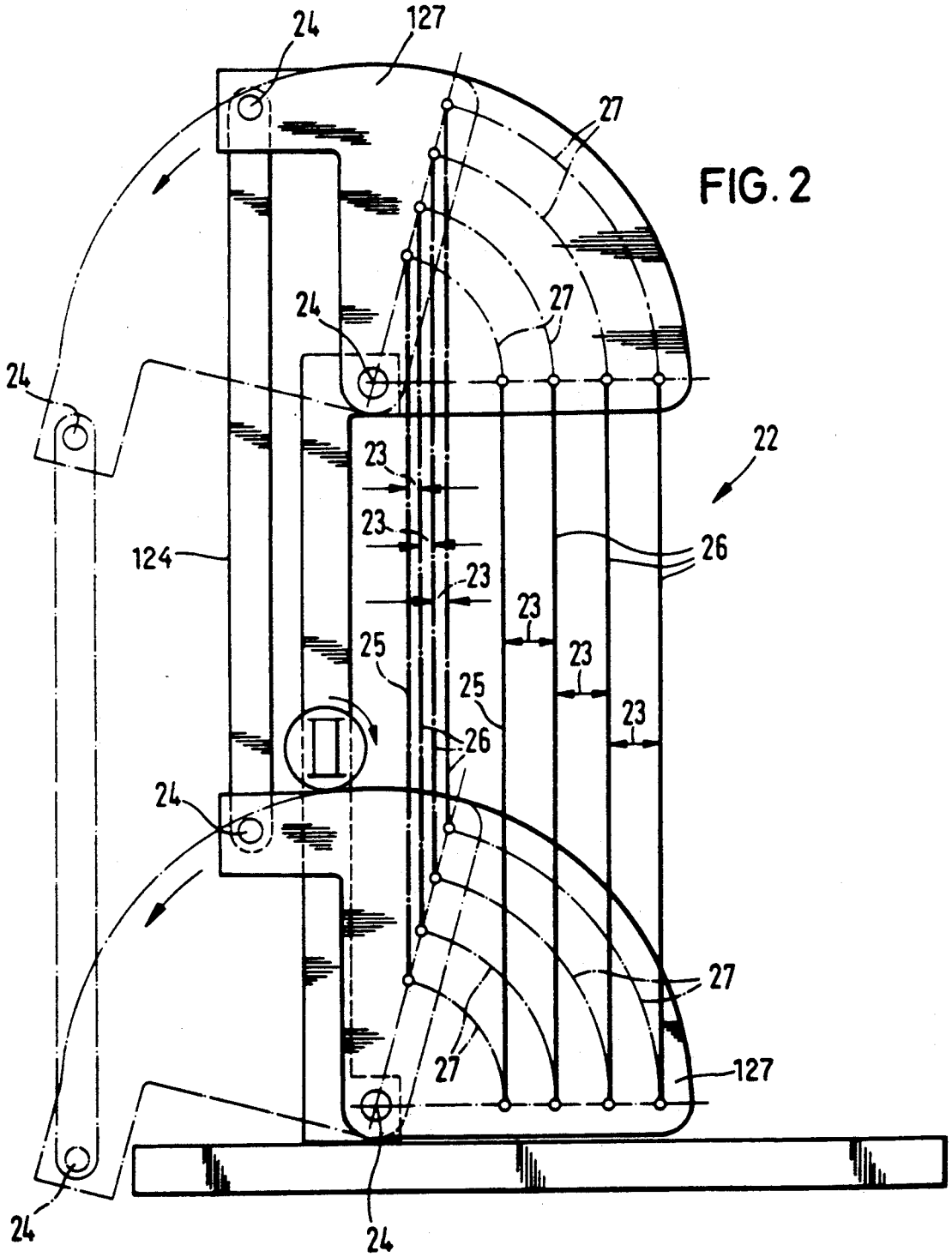
FIG. 2 is a plan view of a mechanical calculator which can be used in conjunction with the apparatus of FIG. 1.

FIG. 2 shows a mechanical finish time calculator 22 which facilitates the evaluation of pictures obtained with the apparatus of FIG. 1. The calculator 22 is provided with a mechanical scale which is adjustable by increments 23 each corresponding to a distance covered within an interval of one-hundredth of a second so as to conform to different speeds of the objects or persons (participants) whose finish times are to be ascertained. To this end, the calculator 22 comprises an adjustable parallelogram with four joints 24. One side (25) of the adjustable parallelogram is parallel with three or even four additional lines or sides 26 which are equidistant from each other and from the side 25. If the neighboring sides of the parallelogram are moved relative to each other about the axes of the respective joints 24, the ends of the sides 25, 26 move along arcuate paths 27 which constitute portions of circles whereby the width of the increments 23 increases or decreases, depending upon the direction of movement of neighboring sides of the parallelogram relative to each other. The sides of the parallelogram can consist of thin taut wires or tensioned yarns or twines.

The two right-hand joints 24 of FIG. 2 are assumed to be stationary, and the two left-hand joints 24 of FIG. 2 are provided on two substantially triangular holders 127 for the ends of the wires 25, 26. When the connector 124 between the two left-hand joints 24 is caused to move these joints along arcs with centers of curvature on the axes of the respective right-hand joints 24, the width of the increments 23 between the wires 25, 26 can be increased from the minimum width (when the wires 25, 26 assume the phantom-line position of FIG. 2) to the maximum width (when the wires 25, 26 assume the solid-line positions of FIG. 2).

The calculator 22 is used as follows: One of the wires or yarns 26 (hereinafter called wires for short) is placed onto the image of the finish line 3 on a picture 28 which is furnished by the printer 12 or onto the image of the finish line 3 on the screen of the monitor 11. Another wire which is adjacent the one wire is placed into the foremost part of the image of the winner 15 in dependency upon the difference between the time of making the respective image and the time of the winner. The calculator 22 then furnishes information pertaining to the distances which were covered by the winner per one-hundredth of a second. This automatically furnishes the finish times of participants 18 and 19 following the winner 15.

It is further within the purview of the invention to install a suitable computer (e.g., a microprocessor) between the camera 6 and the printer 12 in the apparatus of FIG. 1. The input or inputs of the microprocessor receive information denoting the distance between the start and finish lines, and the microprocessor then automatically calculates the average speeds of the participants 15, 20, 21 in response to (first) signals from the transducer 5. This enables the microprocessor to electronically apply to the prints 28 (FIG. 3) which are turned out by the printer 12 a corresponding scale overlying the image of the participant crossing the finish line. Such mode of calculating the distances between successive finishers and the times of certain finishers (such as 18, 19 and 16 in FIG. 1) is quite accurate in spite of the fact that the microprocessor bases its calculations on the average speed of the participant crossing the finish line and triggering the generation of a signal by the transducer 5 rather than on the exact speed of such participant at the time of approaching and actually crossing the finish line. At any rate, such calculation is more accurate than if the times of also rans were calculated on the basis of an average speed of the winner alone.

The microprocessor can be calibrated to calculate a series of speeds in order to form at least one second scale with graduations denoting the distances covered within predetermined increments or fractions of time. Thus, if an object or a person were to cover a distance of one meter within 1/25 of a second, the distance covered per one-hundredth of a second is 25 cm. This amounts to a speed of 90 km/hr. The calculator electronically determines a new scale for each measurement of the actual average speed based on information denoting the distance from the start to the finish line 3. FIG. 3 shows a distance of one meter measured from the finish line 3. All further measurements are or can be based on such distance, and the scale is calculated anew by considering the selected distance as well as the finish times of participants 15, 20, 21. For the purposes of calibration, the camera 6 receives information denoting the location and the setting of the diaphragm, and such setting preferably remains unchanged.

The improved apparatus can be modified so that it is then capable of ascertaining the times of finishers even if successive races or contests are run in such a way that a next-following race or contest begins before the preceding race or contest is finished. For example, a preceding preliminary heat in a 400-yard race involving a large number of participants can still be in progress when the next group of participants is permitted to start the respective heat. Such mode of running successive races or contests is desirable when the number of participants is very large so that it would take up too much time if each following heat, race or another contest were to be started only upon completion of the preceding heat or race. Many foot races (for example, those involving students from several schools, colleges or universities) can be run in the just outlined manner in order to save time, especially if the races are held while the weather is about to change so that some of the races must be postponed or cancelled if the entire contest is not completed within a relatively short period of time.

The apparatus of FIG. 1 can be modified in the above outlined manner by providing at least one additional timing pulse generator 8' for at least two times to be recorded. The additional timing pulse generator or generators 8' are started after the timing pulse generators 8 are already set in operation and are still in operation. For example, if a contest involves several 400-meter races each of which has a total of six participants (matching the number of lanes 2 shown in FIG. 1), a second group of participants can be sent away from the starting line before the participants in the preceding group reach the finish line. The second timing pulse generator 8' is used during the second race and is connected in parallel with the timing pulse generators 8.

It is clear that the just discussed modified apparatus with three or more timing pulse generators can be used with equal advantage to ascertain the times of participants in other types of contests where successive heats or races overlap, for example, bicycle races, ski races and others.

An important advantage of the improved method and apparatus is that they render it possible to accomplish certain apparently conflicting objects such as highly accurate determination of the winning time as well as an equally or nearly equally accurate determination of the times of also rans, even if such also rans do not individually trigger the generation of (first) signals by the monitoring device including the radiation source 4 and the transducer 5. The arrangement preferably is (or can be) such that the first signal which is generated by the monitoring device 4, 5 at the time of crossing the finish line 3 by the winner (15) of the contest is applied to two successive pictures 28, namely to the first picture showing the winner touching or already crossing the finish line 3 and to the next-following picture. This further simplifies the calculation of times of certain also rans (18, 19 and 16 in FIG. 1) in spite of the fact that such also rans are incapable of triggering the generation of discrete first signals (because the radiation beam from the source 4 to the transducer 5 is still interrupted by the winner 15 when the second finisher 18 crosses the finish line 3, because the beam is still interrupted by the second finisher 18 when the third finisher 19 crosses the line 3, and because the third finisher 19 still interrupts the beam when the fourth finisher 16 reaches or crosses the line 3). With reference to FIG. 3, the image following that which is shown therein will bear first information "12:05" and second information "11:99". The first information will denote the time of taking the following image, and the second information will again denote the winning time. The difference between the two first informations (on two successive images) is proportional to the distance covered by the winner 15 between the taking of the first and second pictures 28. Moreover, such mode of applying information to the first picture showing the winner 15 at or beyond the finish line 3 and to the next-following picture renders it possible to rapidly and very accurately calculate the speed of the winner 15 in the region of the finish line 3. If desired, the exact speed of the winner in the region of the finish line 3 can be verified by taking into consideration the picture immediately preceding that of FIG. 3, i.e., the picture showing the winner 15 during the last stage of approaching the finish line 3.

The improved method and apparatus not only enable the operators of the contest to accurately determine the time of the winner and the times of other contestants or participants but they also provide a detailed document pertaining to the outcome of the contest. Such document renders it possible to accurately ascertain the speed of the winner, namely the average speed as well as the speed immediately prior, during or immediately after crossing of the finish line 3. This, in turn, renders it possible to accurately ascertain the times of those participants (such as 18, 19 and 16) who or which do not trigger the generation of a (first) signal by the monitoring device 4, 5 when they cross the finish line 3. The times of the also rans can be ascertained with an accuracy which matches that of the determination of the winner's time, i.e., within not less than 1/100 second.

In ascertaining the times of also rans who did not trigger the generation of a first signal, one can proceed as already discussed above, namely by relying on the image of the winner crossing the finish line 3 and by determining the intervals of time which were required by the also rans on the same image to reach the finish line from their respective positions in such image. Alternatively, the times of the also rans can be ascertained by relying on at least two successive pictures, namely the picture showing the winner nearest to the finish line 3 and the picture immediately preceding and/or immediately following such picture. This renders it possible to ascertain the times of also rans with an even higher degree of accuracy and in a very simple way. The duration of the interval of time between the taking of two successive pictures is known, and the speed of the winner in the region of the finish line 3 is also known or can be calculated in a rather simple way. Such data suffice to permit rapid and accurate ascertainment of the times of also rans on the picture showing the winner nearest to the finish line 3 as well as on the immediately preceding and/or immediately following picture. For example, the exact times of the also rans are then calculated by relying on the times of the winner in each such picture, i.e., by detracting from the winning time for evaluation of the preceding picture and by adding to the winning time for evaluation of the next-following picture. The determination of times of also rans is simple, rapid and inexpensive since one can rely on a rather simple calculator 22 to ascertain the differences between the winning time and the times of participants who or which are sufficiently close to the winner and to each other to prevent them from generating first signals by the monitoring device 4, 5.

Accurate determination of times of the also rans 20 and 21 presents no problems since each of these participants can trigger the generation of a first signal as soon as they reach the finish line 3. If the participant 20 and/or 21 is so slightly ahead of another participant that the other participant does not initiate the generation of a first signal, the time of the other participant is or can be calculated as explained above in connection with the participants 18, 19 and 16, except that, if the average speed of the participant 20, 21 is relied upon, such average speed is evidently less than that of the winner 15. Determination of average speed of those participants (15, 20, 21) who trigger the generation of a first signal on crossing of the finish line 3 and/or the determination of the speed of each of these participants in the region of the finish line can be relied upon to ascertain the times of other participants with a degree of accuracy and fairness which is much higher than that of presently employed methods according to which the times of also rans are calculated by assuming that the average speed of each participant matches the average speed of the winner.

By resorting to the aforediscussed scales, one can immediately and directly read the times of participants following the winner with a degree of accuracy in the range of 1/100 second. If a scale is ascertained electronically, it is projected onto the screen of the monitor 11 or is imaged at least on those pictures which show the winner or any participant who or which has triggered the generation of a first signal in the position nearest to the finish line 3. A relatively simple computer, such as a microprocessor, can carry out the necessary calculations in an absolutely reliable manner and practically instantaneously.

As mentioned above, the method can also involve the making and the calibration of a scale by relying on a marker at a predetermined distance (e.g., one meter) from the finish line 3 (see FIG. 3). Such predetermined distance is used for calculation of distances which are covered during each one-hundredth of a second. Thus, if a participant covers the distance of one meter within four-hundredths of a second (the interval between the taking of two successive pictures), the participant covers a distance of 0.25 meter per 1/100 second which corresponds to a speed of 90 km/hr. This information is used by the computer to calculate the speed of each participant who or which has initiated the generation of a first signal by interrupting the beam of radiation between the source 4 and the transducer 5. The inputs of the computer receive data denoting the distance between the start and the finish line 3 as well as the time of the participant who or which has generated a first signal, and such data enable the computer to calculate, for each such participant, the average speed per hour and to utilize such information in projecting a corresponding scale onto the screen of the monitor 11 and/or onto each print 28. The position of the camera and the f/stop of the camera are selected accordingly. Though such calculations do not take into consideration the exact speed of each and every participant crossing the finish line at the time of reaching the finish line, they are still much more accurate and reliable than those which are based on a fictitious or more or less arbitrarily selected average speed for all also rans in the contest. At the very least, the average speed on which the computer relies in its calculations is ascertained on the basis of the speed or speeds of one or more participants in the contest and not on some empirically obtained data as is customary in accordance with heretofore known methods.

The video recorder 9 is preferably designed to advance still pictures forwardly and rearwardly, always when a full picture was taken, together with the corresponding information, so that the printer 12 can then furnish a photograph with the selected information thereon. The timing pulse generators 8 between the camera 6 and the video recorder 9 are operated in synchronism. The monitor 11 can form a component which is built into the video camera 6, or it can constitute a separate part (as actually shown in FIG. 1). The purpose of the monitor 11 is to enable the operator to locate the still images which are of interest and/or to calculate the times of certain participants directly on the screen of the monitor 11.

The video camera 6, the recorder 9, the monitor 11 and the printer 12 constitute commercially available components. The camera 6 is preferably selected with a view to ensure that it can take sharp or at least highly acceptable pictures at the desired frequency, e.g., at intervals of minute fractions of a second. Moreover, it is desirable to select a printer 12 which is capable of taking into consideration grey shades so that it can make adequate prints from pictures which are taken with a video camera.

It goes without saying that the timing pulse generators 8 and 8' are provided with suitable resetting means (not specifically shown). Each of these timing pulse generators can receive a starting impulse from the starter gun 13.

Modified calculators 22 operating with somewhat different scales (note the scale of FIG. 3) are shown in FIGS. 4 to 8. The increments 23 between neighboring lines 29, 30 (corresponding to lines 17 of FIG. 1) of the scale shown in FIG. 3 are assumed to correspond to intervals equaling one-hundredth of a second. The modified calculators 22 are designed to take into consideration the perspectives of the images which are furnished by the monitor 11 or by the printer 12. The scale which is furnished by a modified calculator 22 is projected or placed onto the print 28 (see, for example, FIG. 3) or onto the image on the screen of the monitor 11. The scale of the calculator 22 which is shown in FIG. 3 has a reference line 29 which can be placed into register with the finish line 3 so that it extends transversely of the direction of advancement of the participants. In FIG. 3, the image on the print 28 shows a participant (winner) 15 in a foot race, and such person has already crossed the finish line 3 so that a portion of her body is located to the right (ahead) of the finish line while the remainder of her body is still behind the finish line.

The reference line 29 is flanked by additional lines 30 with the mutual spacing 23 of neighboring lines 29, 30 matching the distance which is covered by the winner 15 within one-hundredth of a second. FIG. 3 shows four additional lines 30 at each side of the reference line 29. All of the lines 29, 30 intersect at a perspective center 31 of the camera 6 so that the mutual spacing of neighboring lines 29 and 30 increases in a direction away from the center 31. The locus of the center 31 is indicate of the perspective as seen from the video camera 6, i.e., of the perspective of the image on the print 28 of FIG. 3. Such mode of selecting the positions of lines 29, 30 relative to each other renders it possible to ascertain the times of participants with an even higher degree of accuracy since the apparatus takes into consideration the fact that the distance between successive participants running in the lanes 2 which are more distant from the camera 6 appears to be less than the distance between participants in those lanes which are nearer to the camera, even though the distances between participants in the far lanes and participants in the near lanes are the same. As explained above, this can be achieved by the simple expedient of employing a calculator which contains or which can project lines 29, 30 in a manner as shown in FIG. 3 so that the mutual inclination of neighboring lines 29, 30 corresponds the perspective of the area around the finish line 3 as seen from the camera 6.

The scale which is furnished by the calculator 22 of FIG. 3 can be caused to conform to different speeds which are ascertained in the aforedescribed manner. Such conformance can be achieved in a relatively simple manner in that the entire scale is shiftable in the direction of the finish line 3, i.e., in the direction of the reference line 29 toward or away from the perspective center 31. One must shift the scale which is provided by the calculator 22 of FIG. 3 in such a way that those portions of lines 29, 30 which are nearer to each other (i.e., nearer to the center 31) overlap the image of the winner 15 on the print 28 if the speed of the participants is lower, and that portions of lines 29, 30 which are disposed at a greater distance from each other overlie the image of the winner 15 on the print 28 if the participants run or travel at a higher speed.

The lines 29, 30 of the scale which is provided by the calculator 22 of FIG. 3 are flanked by two additional scales having rows of graduations 32 which denote different speeds in kilometers per hour. The additional scales are shifted so that the graduations 32 denoting the ascertained speed of the winner 15 are in line with the image of the winner, and this enables the person observing the image on the print 28 to even more accurately ascertain the time of the winner if the image on the print was made (as shown in FIG. 3) at a time when the winner has already crossed the finish line 3. The primary scale including the lines 29, 30 is then projected onto the image of the print 28 by fully considering the average speed (30 km) of the winner 15, i.e., the primary scale which is shown in FIG. 3 is applied in proper position to show that the chest of he winner 15 has crossed the finish line a little less than two-hundredths of a second prior to taking of the picture 28. Thus, it is necessary to ascertain the average speed of the winner 15 in a heat or race and to thereupon apply the primary scale including the lines 29, 30 to the image on the picture 28 in such a way that the graduation 32 (denoted by the character 33) which indicates the ascertained speed of the winner 15 is in proper relation to the image of the winner on the picture 28. If the image on the picture 28 shows two or more participants, such as the participants 15, 18, 19 and 16 shown in FIG. 1, the primary scale including the lines 29, 30 automatically shows the times of the participants 18, 19, 16 once the primary scale is applied in a manner as shown in FIG. 3, i.e., the peruser of the primary scale will immediately note that the second finisher was one-hundredth of a second behind the winner 15, and so forth. Moreover, such peruser will be able to ascertain the times of the participants 18, 19 and 16 with a high degree of accuracy in spite of the fact that the participant 16 will be more distant from the camera 6 than the participant 19 and the participant 18 will be more distant from the camera than the winner 15 but nearer to the camera than the participant 18. In fact, the calculator 22 of FIG. 3 can be used to ascertain the exact times of the participants with a degree of accuracy which even exceeds one-hundredth of a second.

Figure 5:
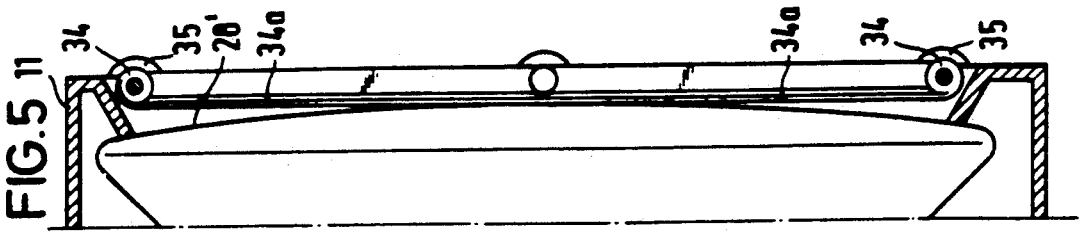
FIG. 5 is a sectional view as seen in the direction of arrows form the line A—A of FIG. 4.
Figure 4:
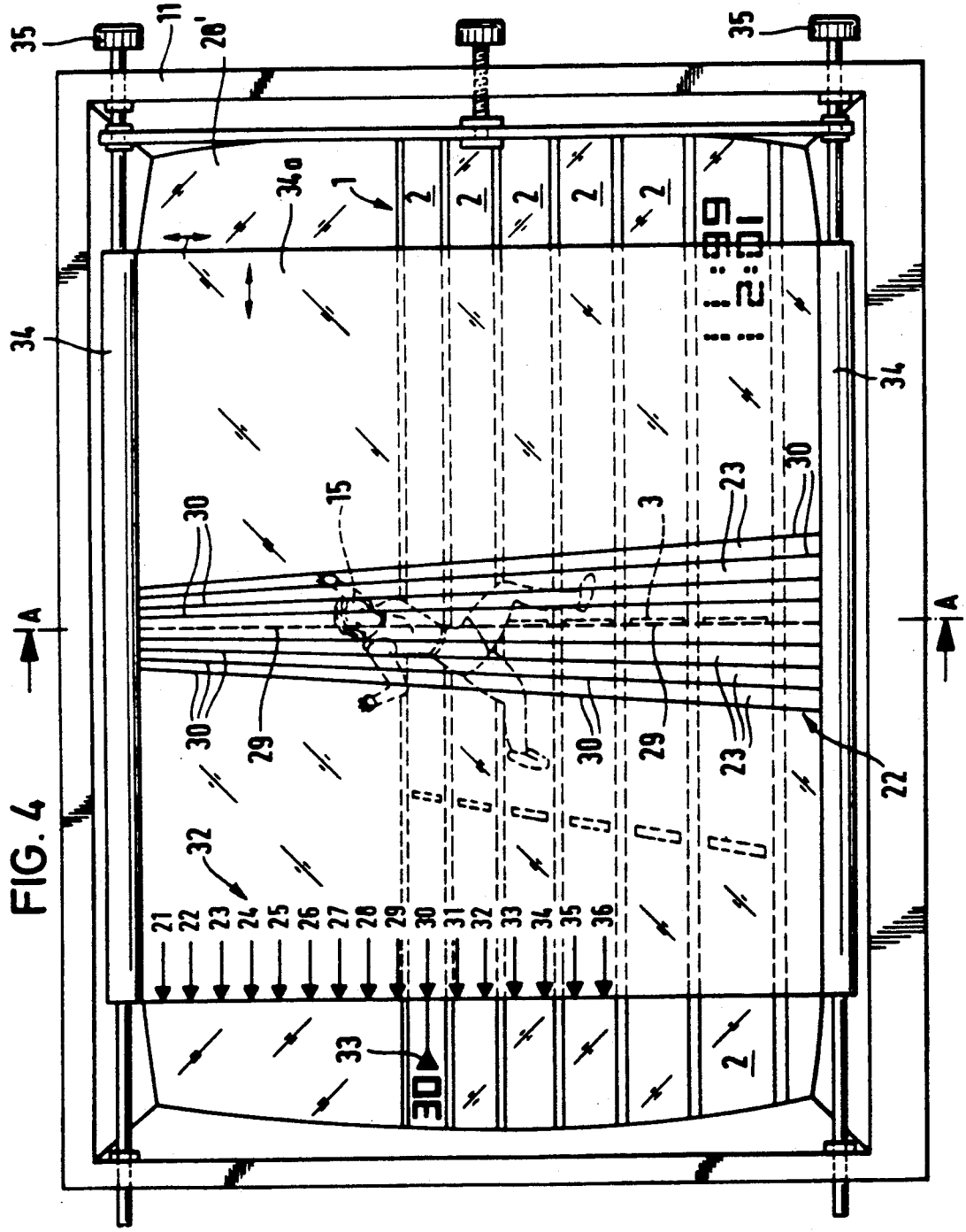
FIG. 4 is a plan view of a calculator which can be employed to furnish the scale of FIG. 3.

One presently preferred embodiment of a calculator 22 which can be used in a manner as described in connection with FIG. 3 is shown in FIGS. 4 and 5. This calculator is designed to project a scale onto the screen of the monitor 11. A calculator which can apply a scale to a print 28 is shown in FIGS. 6 to 8.

Referring to FIGS. 4 and 5, the primary scale including the lines 29 and 30 (which intersect each other at the center 31) is applied to a transparent or translucent carrier 34a which is located in front of the screen 28' of the monitor 11. The carrier 34a of FIGS. 4 and 5 is a transparent foil whose end portions are attached to two advancing members in the form of rolls 34 rotatable by knobs 35 in clockwise and counterclockwise directions so as to wind the carrier 34a onto the upper roll 34 of FIG. 4 while the lower roll 34 pays out the carrier or vice versa. The direction of advancement of the carrier 34a in response to rotation of the rolls 34 (which turn in the same direction) coincides with the direction of the reference line 29. The mutual spacing of rolls 34 matches or slightly exceeds the width of the image-bearing portion of the screen forming part of the monitor 11. The operator manipulates one of the knobs 35 in order to move the graduation 32 corresponding to the ascertained speed of the person shown on the screen of the monitor 11 in order to permit calculation of the time of the winner and of other participant or participants appearing on the screen in a manner as described above in connection with FIG. 3.

The accuracy of the calculator 22 which is shown in FIGS. 4 and 5 can be enhanced still further by providing the calculator with means for moving the carrier 34a laterally, i.e., in the longitudinal direction of the advancing rolls 34. In other words, the primary scale including the lines 29, 30 can also be moved in the direction of travel of participants in their respective lanes 2. For example, the rolls 34 can be pushed or pulled by their respective knobs 35 within limits which are imposed by the frame for these rolls so as to move the entire carrier 34a in a direction to the right or to the left (as seen in FIG. 4). Other means for moving the carrier 34a can be employed with equal or similar advantage. Such adjustability of the carrier 34a enables the operator to move the reference line 29 into a position of exact register with the finish line 3. One of the additional scales with its row of graduations 32 has been omitted in FIG. 4 for the sake of simplicity and clarity.

Figure 7:
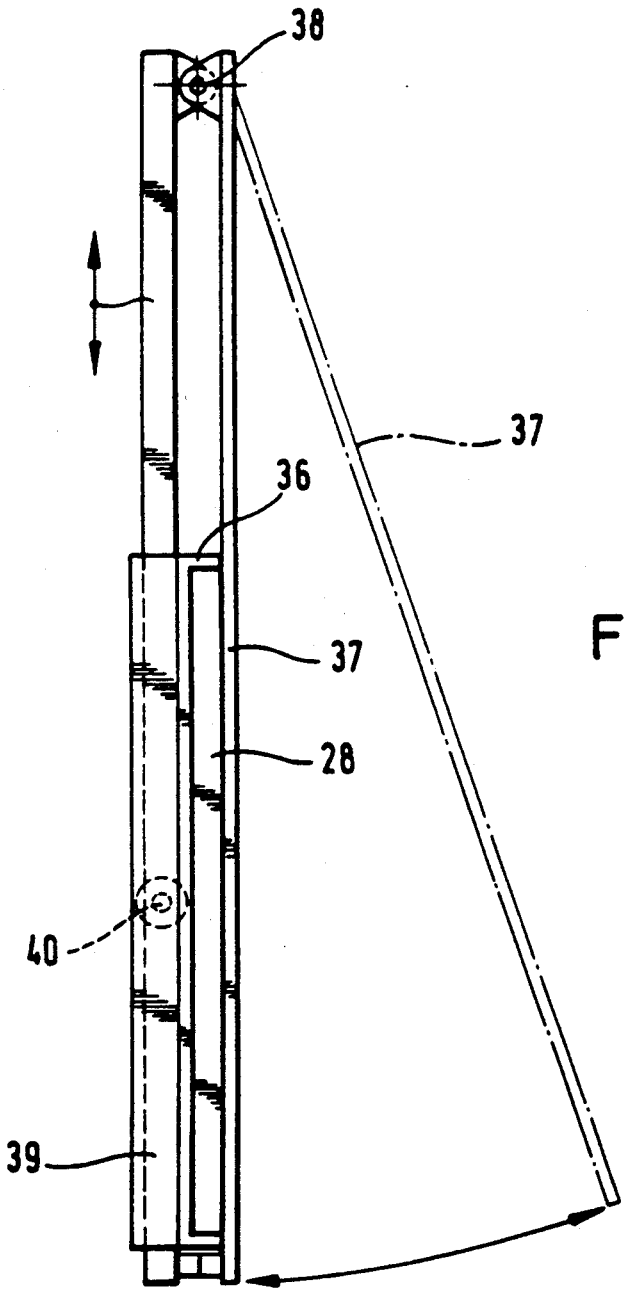
FIG. 7 is a side elevational view of the calculator which is shown in FIG. 6.

FIGS. 6 to 8 show the details of the aforementioned calculator 22 which can be used in conjunction with the printer 12, and more specifically with prints 28 which are furnished by the printer. This calculator has a frame with a chamber for reception of a print 28 so that the print is disposed beneath a stiff transparent or translucent carrier 37 of the primary scale including the lines 29, 30 and the perspective center 31. The carrier 37 is mounted on a hinge 38 defining a pivot axis which extends at right angles to the reference line 29 and includes or is close to the center 31. Pivoting of the carrier 37 about the axis of the hinge 38 is advisable and advantageous in order to facilitate introduction of the print 28 into the aforementioned chamber. A properly inserted picture 28 is located in a guide 36 which engages its marginal portions and is movable in the direction of the reference line 29 for the purposes as set forth in connection with FIG. 3, i.e., to place the image of the participant (15 in FIG. 6) in line with that graduation 32 (shown at 33) which denotes the average speed of the participant 15 between the starting and finish lines. As can be seen in FIG. 7, a follower 39 of the guide 36 and the picture 28 are movable along at least one tie rod or any other support in directions indicated in FIG. 7 by a double-headed arrow. In addition, the guide 36 is shiftable at right angles to the line 29 by a screw or knob 40 so that the operator can move the reference line 29 into exact register with the finish line 3 on the image of the picture 28. The screw or knob 40 can further serve as a means for fixing the guide 36 for the picture 28 in a selected optimum position in which the graduation 33 is properly positioned with reference to the image of the participant 15.

The primary scale which is shown in FIGS. 3, 4 and 6 can be modified by reducing the number of lines 30 to six, namely three at each side of the reference line 29. It is preferred to provide a total of eight lines 30 if the camera 6 is set to take pictures at intervals of four one-hundredths of a second because each increment 23 then corresponds to the distance which is covered within 1/100 second. However, it is also possible to employ a primary scale with a reference line 29 and only six lines 30, even if the camera 6 is set to take pictures at intervals of 1/25 second. This will be readily appreciated by looking again at FIG. 1 which shows that the difference between the times of the first four participants is three one-hundredths of a second. The calculator 22 which is shown in FIG. 2 comprises a primary scale with a total of four lines or wires, namely the reference wire or line 25 and three additional wires or lines 26.

The primary scale can be applied to the center of the image of the track 1 in the region of the finish line 3 or to one or two parallel marginal portions of the picture 28. The calculator 22 which provides such a scale can be an integral part of the apparatus so that the primary scale is imaged each time the camera 6 takes a picture. This even further simplifies the determination of times of participants who or which do not generate a first signal at the time of crossing of the finish line 3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of ascertaining the times which elapse during contests between animate and/or inanimate participants, such as during foot races, automobile races, dog races and horse races, wherein the finish line is imaged by at least one camera and is monitored by at least one monitoring device which generates a signal when the finish line is crossed by a participant including the initial crossing by the winner of the contest as well as each crossing by an also ran reaching the finish line after the preceding finisher or finishers have advanced beyond the finish line, comprising the steps of making with the camera a sequence of pictures of the finish line and its surroundings at predetermined intervals, said step of making a sequence of pictures comprising a first recording step including recording on successive pictures of said sequence first information including those periods of time which elapse between the start of the contest and the instants of taking successive pictures at said predetermined intervals; and a second recording step including recording on the respective pictures second information denoting those periods of time which elapse between the start of the contest and the generation by the monitoring device of said signal when the winner and each also ran who or which has triggered the generation of said signal by the monitoring device crosses the finish line so that each picture which images a participant crossing the finish line and triggering the generation of said signal bears the corresponding first information and the respective second information.

2. The method of claim 1, wherein each of said intervals equals four-hundredths of a second.

3. The method of claim 1, further comprising the step of generating a signal at the start of the contest so that the difference between the times of generating the signal at the start of the contest and generating the signal by the monitoring device when the winner crosses the finish line is directly indicative of the time spent by the winner to complete the contest from the start to the finish line.

4. The method of claim 1, further comprising the step of imaging onto the picture bearing said second information an electronically determined scale with graduations denoting a series of distances covered by the winner per predetermined unit of time.

5. The method of claim 1, further comprising the step of recording said second information on at least one picture immediately following the picture which is being taken at the time of generation of a signal by the monitoring device so that each such following picture bears the image of the finish line, of the participant whose crossing of the finish line has initiated the recording of second information as well as different first information and said second information, the difference between the first and second information on a following picture being proportional to the distance the participant whose crossing of the finish line has initiated the generation of the respective signal by the monitoring device has advanced beyond the finish line.

6. The method of claim 1 of ascertaining the times which elapse during contests between participants crossing the finish line in such close proximity to one another that one of the participants initiates the generation by the monitoring device of a signal as a result of crossing of the finish line but at least one additional participant trails the one participant by a distance such that the additional participant does not initiate the generation of a signal by the monitoring device because the additional participant crosses the finish line before the one participant has advanced all the way beyond the finish line, comprising the additional steps of ascertaining the distance which is covered by the additional participant during the interval which has elapsed between the making of at least two successive pictures bearing the images of the additional participant in the region of the finish line, and calculating the time differential between completions of the contest by the one participant and by the additional participant on the basis of said distance and said predetermined interval between the making of said at least two successive pictures.

7. The method of claim 6, wherein said calculating step includes subdividing the interval between the making of said at least two successive pictures into shorter intervals and adding one or more shorter intervals to or subtracting one or more shorter intervals from the second information on the picture immediately following the picture taken at the time of the generation by the monitoring device of a signal as a result of crossing of the finish line by the one participant.

8. The method of claim 1, further comprising the step of subdividing the distance covered by each participant whose crossing of the finish line has triggered the generation by the monitoring device of a signal between the positions shown on the picture bearing said second information and a following picture into distances covered by the respective participant during a predetermined unit of time, such as one hundredth of a second.

9. The method of claim 1, further comprising the step of determining the distance covered during a predetermined unit of time, such as one hundredth of a second, by each participant whose crossing of the finish line has triggered the generation of a signal by the monitoring device, including establishing the difference in time between the first and second information on the picture bearing the image of the participant whose crossing of the finish line has triggered the generation of a signal by the monitoring device and establishing from the picture bearing said image the total distance covered by the respective participant during the period between the crossing of the finish line - as denoted by the second information - and the recording of the first information.

10. The method of claim 9, further comprising the step of projecting onto the picture bearing said image a scale with graduations denoting a series of distances corresponding to that covered during said predetermined unit of time so that one of the graduations coincides with the image of the finish line or is equidistant from the image of the finish line and a neighboring graduation.

11. The method of claim 10, wherein said determining step includes electronically computing the distance covered per one hundredth of a second and imaging the respective scales on the pictures showing the participants whose crossing of the finish line has triggered the generation of signals by the monitoring device.

12. The method of claim 11, wherein said computing step includes utilizing the distance from the start to the finish line as one of the parameters for determination of the distance covered per one hundredth of a second and utilizing as another parameter an arbitrarily selected unit distance from the finish line such as is covered by an object moving at a predetermined speed within one of said intervals.

13. The method of claim 11, further comprising the step of projecting onto the picture bearing said image an additional scale with graduations denoting a series of different speeds including the speed of the participant in said image.

14. The method of claim 1, further comprising the step of determining the sped of each participant whose crossing of the finish line has triggered the generation of a signal by the monitoring device, including establishing the difference in time between the first and second information on the picture bearing the image of the participant whose crossing of the finish line has triggered the generation of a signal by the monitoring device and establishing from the picture bearing said image the total distance covered by the respective participant during the period between the crossing of the finish line—as denoted by the second information—and the recording of first information.

* * * * *